US008113684B2

(12) United States Patent
Quercia et al.

(10) Patent No.: US 8,113,684 B2
(45) Date of Patent: Feb. 14, 2012

(54) FLUORESCENT LAMP SUPPORT

(75) Inventors: Robert Quercia, Garden City, NY (US); Greg Galluccio, Hauppauge, NY (US); Antony Tufano, N. Massapequa, NY (US); Francisco Schapira, Valley Stream, NY (US); Ruel Sarino, Port Washington, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 822 days.

(21) Appl. No.: 12/173,171

(22) Filed: Jul. 15, 2008

(65) Prior Publication Data

US 2010/0013391 A1 Jan. 21, 2010

(51) Int. Cl.
*F21V 19/02* (2006.01)

(52) U.S. Cl. ..... 362/220; 362/217.08; 362/217.12; 362/217.13; 362/217.16; 362/217.17; 362/260; 362/287

(58) Field of Classification Search ..... 362/147, 362/220, 217.01, 217.1, 217.12–217.14, 362/217.16, 217.17, 257, 260, 285, 287, 362/217.08
See application file for complete search history.

(56) References Cited

U.S. PATENT DOCUMENTS

| | | | |
|---|---|---|---|
| 2,163,902 | A | 6/1939 | Wertzhelser |
| 3,297,977 | A | 1/1967 | Smith |
| 3,384,858 | A | 5/1968 | Johnson |
| 3,397,376 | A | 8/1968 | Gombar |
| 3,401,242 | A | 9/1968 | Mclaughin |
| 3,524,053 | A | 8/1970 | Johnson |
| 3,568,132 | A | 3/1971 | Johnson |
| 3,611,026 | A | 10/1971 | Crawford |
| 3,631,376 | A | 12/1971 | Halfaker |
| 3,634,681 | A | 1/1972 | Johnson et al. |
| 3,639,887 | A | 2/1972 | Johnson et al. |
| 3,651,445 | A | 3/1972 | Francis |
| 3,654,587 | A | 4/1972 | McLaughlin |
| 3,681,593 | A | 8/1972 | Genovese et al. |
| 3,681,594 | A | 8/1972 | Johnson |

(Continued)

FOREIGN PATENT DOCUMENTS

CN 1481119 A 3/2004

(Continued)

OTHER PUBLICATIONS

Leviton Manufacturing Co., Inc., Leviton OEM100 Catalog—100th Anniversary Edition, Sections A and B, (c) 2005 Leviton Manufacturing Co., Inc., Little Neck, NY.

(Continued)

*Primary Examiner* — Thuy Vinh Tran
(74) *Attorney, Agent, or Firm* — Weiss & Arons, LLP

(57) ABSTRACT

Apparatus and methods for supporting a lamp. The apparatus may include a ballast, a rigid power distribution unit, and a lamp holder. The lamp holder may be in electrical communication with the rigid power distribution unit. The rigid power distribution unit may include a track that has conducting rails for supplying power to lamp holders. The track may be used to position lamp holders at any desired spacing so the track may be used in connection with fixture designs requiring different center-to-center lamp spacing. In some embodiments, the rigid power distribution unit may include a printed circuit board. The lamp holder may clamp or be soldered onto the printed circuit board and draw power from it. The printed circuit board may have traces from each lamp holder to be plugged into it.

29 Claims, 6 Drawing Sheets

U.S. PATENT DOCUMENTS 3,685,003 A 8/1972 Watt
3,752,977 A 8/1973 Davis
3,771,106 A 11/1973 Matsumoto et al.
3,828,299 A 8/1974 Johnson et al.
3,836,814 A 9/1974 Rodriquez
3,851,295 A 11/1974 Geier
3,975,073 A 8/1976 McLaughlin
4,084,873 A 4/1978 Grate
4,101,956 A 7/1978 Crane
4,102,558 A 7/1978 Krachman
4,198,108 A 4/1980 Bassetto
4,198,109 A 4/1980 Ustin
4,280,169 A 7/1981 Allen
4,298,918 A 11/1981 Metcalf
4,306,758 A 12/1981 Johnson et al.
4,347,460 A 8/1982 Latassa et al.
4,414,489 A 11/1983 Young
4,454,569 A * 6/1984 Maguire ..... 362/127
4,495,443 A 1/1985 Cummings
4,542,947 A 9/1985 Flor et al.
4,565,415 A 1/1986 Feinberg
4,570,105 A 2/1986 Engel
4,617,519 A 10/1986 Rosenthal
4,623,823 A 11/1986 Engel
4,637,671 A 1/1987 Johnson et al.
4,643,503 A 2/1987 Johnson et al.
4,645,283 A 2/1987 MacDonald et al.
4,660,906 A 4/1987 Haraden
4,683,402 A 7/1987 Aubrey
4,688,874 A 8/1987 Bjorkman
4,723,200 A 2/1988 Troen
4,744,767 A 5/1988 Henrici et al.
4,746,840 A 5/1988 Lim
4,754,197 A 6/1988 Zwald
D297,322 S 8/1988 Johnson et al.
D297,529 S 9/1988 Johnson et al.
4,772,216 A 9/1988 Szymanek
4,804,343 A 2/1989 Reedy
4,863,394 A 9/1989 Henshaw, Jr.
D304,716 S 11/1989 Johnson et al.
4,936,789 A 6/1990 Ugalde
4,939,420 A 7/1990 Lim
5,006,970 A 4/1991 Mackiewicz
5,015,917 A 5/1991 Nigg
5,044,974 A 9/1991 Pelton et al.
5,122,074 A 6/1992 Maag et al.
5,135,407 A 8/1992 Berends
5,150,008 A 9/1992 Lee
5,169,331 A 12/1992 Caldwell et al.
5,189,339 A 2/1993 Peshak
5,202,607 A 4/1993 Broyer et al.
5,261,831 A 11/1993 Vendal et al.
5,282,755 A 2/1994 Ahlstone
5,320,547 A 6/1994 Mews et al.
5,320,548 A 6/1994 Schadhauser
5,390,096 A 2/1995 DeKleine et al.
5,446,617 A 8/1995 Blocher et al.
5,596,247 A 1/1997 Martich et al.
5,616,042 A 4/1997 Raby et al.
5,634,820 A 6/1997 Vakil
5,636,919 A 6/1997 Walker
5,653,527 A 8/1997 Muessli
5,688,139 A 11/1997 Gust et al.
5,727,869 A 3/1998 Crosby et al.
5,743,626 A 4/1998 Walker
5,746,615 A 5/1998 Ichikawa et al.
5,751,117 A 5/1998 Abbott et al.
5,758,952 A 6/1998 Getselis et al.
5,759,054 A 6/1998 Spadafore
5,816,837 A 10/1998 Henrici et al.
5,855,487 A 1/1999 Kunishi
D406,814 S 3/1999 Henrici
5,931,691 A 8/1999 Mews et al.
5,971,564 A 10/1999 Wang
5,982,645 A 11/1999 Levran et al.
D417,653 S 12/1999 Henrici
6,027,230 A 2/2000 Huber et al.
6,039,597 A 3/2000 Getselis et al.
6,048,220 A 4/2000 Altman et al.
6,082,873 A 7/2000 Schmidt
6,124,673 A 9/2000 Bishop
6,159,029 A 12/2000 Burwell
6,164,797 A * 12/2000 Crane et al. ..... 362/221
6,290,522 B1 9/2001 Campolo et al.
6,340,310 B2 1/2002 Henrici et al.
6,517,216 B1 * 2/2003 Cercone et al. ..... 362/220
6,561,828 B2 5/2003 Henrici et al.
6,565,230 B2 5/2003 Ashley
6,570,306 B2 5/2003 Henrici et al.
6,582,253 B1 6/2003 Lau
6,632,100 B1 10/2003 Richardson
6,641,419 B1 11/2003 Richardson
D491,890 S 6/2004 Henrici et al.
D493,425 S 7/2004 Henrici et al.
6,869,298 B2 3/2005 Latsis
6,884,103 B1 4/2005 Kovacs
7,090,390 B2 8/2006 Pazula
7,097,327 B1 8/2006 Barton
7,125,159 B2 10/2006 Hirsch et al.
7,153,151 B2 12/2006 Lingemann et al.
7,247,040 B2 7/2007 Lingemann et al.
D550,884 S 9/2007 Tufano et al.
7,291,029 B2 11/2007 Hale et al.
7,322,722 B2 1/2008 Hartmann et al.
D564,129 S 3/2008 Tufano et al.
7,338,302 B2 3/2008 Thiele et al.
7,339,790 B2 3/2008 Baker et al.
D577,854 S 9/2008 Tufano et al.
7,448,892 B2 11/2008 Dowdle et al.
7,520,763 B1 * 4/2009 Buse ..... 439/121
2003/0068913 A1 4/2003 Henrici et al.
2003/0100210 A1 5/2003 Lewis
2003/0123252 A1 7/2003 Cercone et al.
2005/0026483 A1 2/2005 Latsis
2005/0104524 A1 5/2005 Bishop
2005/0148242 A1 7/2005 Latsis
2005/0202704 A1 9/2005 Lingemann et al.
2006/0170323 A1 8/2006 Hirsch et al.
2006/0245186 A1 * 11/2006 Stillman ..... 362/225
2006/0273730 A1 12/2006 Chang
2007/0066112 A1 3/2007 Tufano et al.
2007/0077801 A1 4/2007 Lingemann et al.
2007/0117466 A1 5/2007 Thiele et al.
2007/0183160 A1 8/2007 Tufano et al.

FOREIGN PATENT DOCUMENTS

EP 0621661 A2 3/1998
EP 0834967 A2 4/1998
EP 1562269 A1 8/2005
JP 61-103887 5/1986
JP 62-104384 5/1987

OTHER PUBLICATIONS

Harris, T., How Fluorescent Lamps Work, http://howstuffworks.com/fluorescent-lamp.htm, Feb. 8, 2008.
Written Opinion of the International Searching Authority, International Application No. PCT/US2009/050742 (which claims the benefit of the above-referenced application).
"How Stuff Works Article", /www.home.howstuffworks.com/flourescent-lamp.htm/ © 1998-2008 HowStuffWorks, Inc.
App No. PCT/US/2009/050742 International Search Report.

* cited by examiner

FLUORESCENT LAMP SUPPORT

BACKGROUND

This application relates to apparatus and methods for supporting and powering fluorescent lamps. In particular, the application relates to apparatus and methods for distributing power from a ballast to a lamp holder.

Normally, when a fluorescent fixture is built by a fixture manufacturer, the manufacturer will start with an enclosure (typically sheet metal) and insert fluorescent lamp holders at either end of the fixture a nominal distance apart. The distance will usually depend on the length of fluorescent lamp or tube for which the fixture is designed. When multiple lamps are to be installed, the lamp holders will be positioned across the width of the fixture at nominal distances. Then, a ballast will be mounted to the enclosure in a location that is hidden from the end user. Then wires will be connected from the ballast to each lamp holder (the wires may already be part of the ballast).

In order to assemble a fluorescent fixture in this manner, several manual steps need to be performed. There may be numerous wires that connect the ballast to the lamp holders that the factory and installer may have to contend with. This can lead to wiring errors or simply an unappealing installation.

Lamps that are assembled in this manner may require features that are designed for a predetermined width-wise placement of the lamps. For example, the installation of lamps at 2-inch center-to-center distances would require a crossbar configured to engage lamp holders, and provide power, at those locations. If it were then desirable to manufacture a fixture having lamps at different center-to-center distances, a different crossbar would be required.

It would be desirable, therefore, to provide apparatus and methods that reduce the likelihood of manufacturing errors.

It would also be desirable, therefore, to provide apparatus and methods that reduce the requirement for fixture components having different center-to-center distances.

SUMMARY OF THE INVENTION

It is an object of the invention to provide apparatus and methods that reduce the likelihood of manufacturing errors. It is a further object of the invention to provide apparatus and methods that reduce the requirement for different fixture components having different center-to-center distances.

Accordingly, apparatus and methods for supporting and energizing a fluorescent lamp are provided. The apparatus may include a ballast, a rigid power distribution unit; and a lamp holder. The lamp holder may be in electrical communication with the rigid power distribution unit such that when the lamp holder supports a lamp, the lamp holder is configured to provide power from the rigid power distribution unit to the lamp. Some embodiments, therefore, may not require the use of wires to transmit power from the ballast to the lamp holder. The lamp may be any suitable lamp, including T5, T8 and T12 lamps. The rigid power distribution unit may include a track that has conducting rails for supplying power to lamp holders. The track may be used to position lamp holders at any desired spacing so the track may be used in connection with fixture designs requiring different center-to-center lamp spacing.

In some embodiments, the rigid power distribution unit may include a printed circuit board. The lamp holder may clamp onto or be otherwise mechanically and electrically connected to the printed circuit board and draw power from it.

The printed circuit board may have traces for each lamp holder. In some embodiments, conductive buses may be used either as traces on the printed circuit board or separate from the printed circuit board.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF EMBODIMENTS

Figure 1:
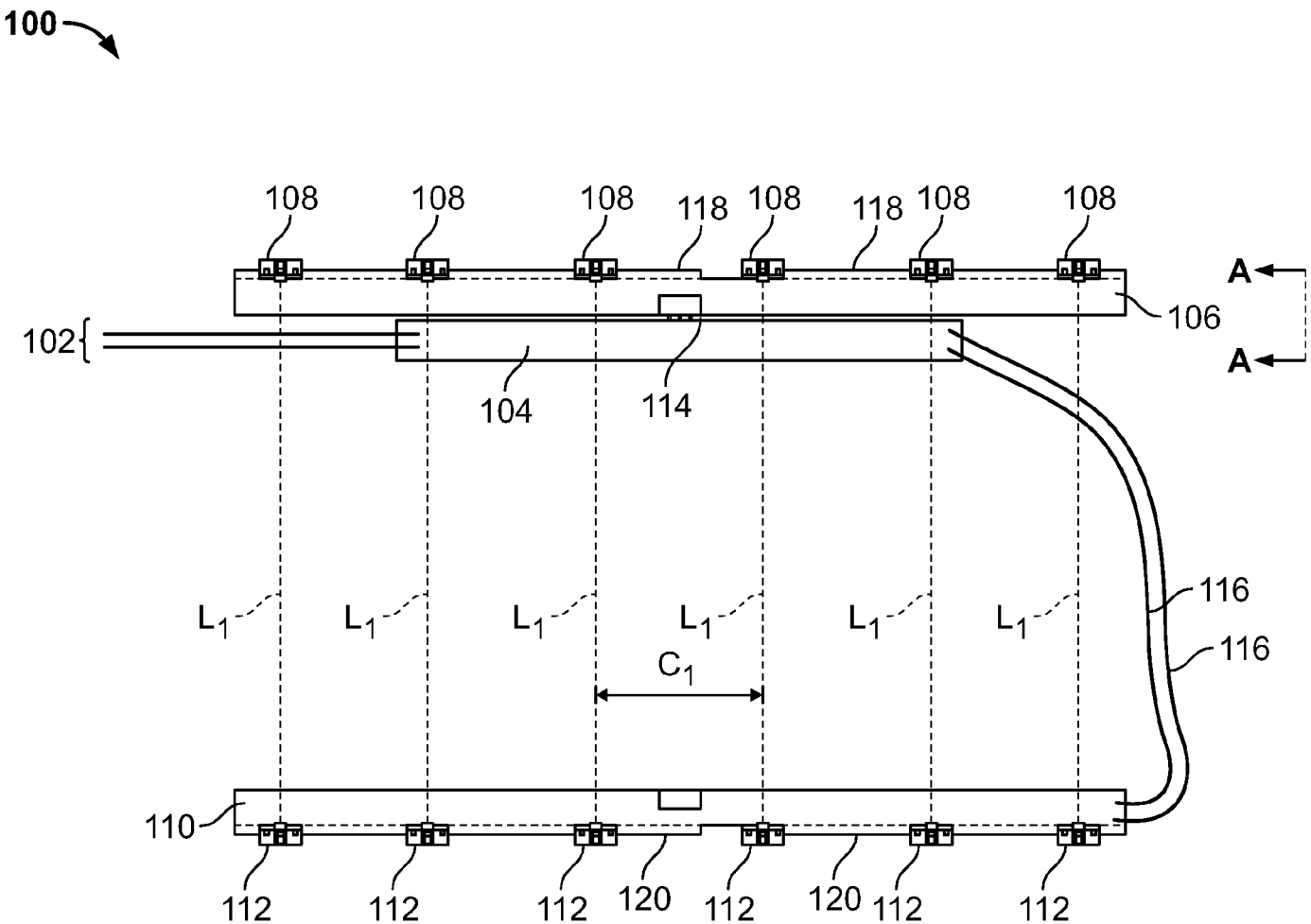
FIG. 1 is a schematic diagram of an apparatus in accordance with the present disclosure.

Apparatus and methods for supporting and powering a fluorescent lamp are provided. The apparatus preferably includes a ballast, a rigid power distribution unit; and a lamp holder. The ballast receives power from a standard power line, such as a 110 VAC power line or any other suitable power line. The ballast preferably has a reactive coil and a power conditioner for providing appropriate current to the lamp via the rigid power distribution unit. The rigid power distribution preferably distributes the power to one or more lamp holders. The lamp holders preferably are directly supported by the rigid power distribution unit.

The lamp holders shown and described herein may hold and excite one end of a tube-shaped lamp. Generally, when long tubes are used, two opposing lamp holders (one at each end of the lamp) are usually required—one to support and excite each end of the lamp. Each of the opposing lamp holders may be supported by a rigid power distribution unit.

The lamp holder may is in electrical communication with the rigid power distribution unit such that when the lamp holder supports a lamp, the lamp holder is configured to provide power from the rigid power distribution unit to the lamp. Some embodiments, therefore, may not require the use of wires to transmit power from the ballast to the lamp holder. The lamp may be any suitable lamp, including T5, T8 and T12 lamps.

In some embodiments, the rigid power distribution unit includes a track that has conducting rails for supplying power to lamp holders. The rails may run along a portion of the track so that lamp holders engaging the portion may receive power from the rails. The track may include a slot or edge along which the lamp holders may slide. The track may include one or more detents to maintain a lamp holder in a position along the track. In manufacturing, the track may be used to position lamp holders at any desired spacing so the track may be used in connection with fixture designs requiring different center-to-center lamp spacing. The spacing may optionally be standardized to accommodate one or more of the various industry standards.

In some embodiments, a method for manufacturing a fluorescent lamp support includes mating a ballast connector to a rigid power distribution unit connector to form an electrical connection between them. The method further includes sliding a lamp holder from a first position in the track to a second position in the track. The rigid power distribution unit may include a track along which the lamp holder may slide. The rigid power distribution unit may include conducting rails for providing power to the lamp holder at different positions along the track.

In some embodiments, the rigid power distribution unit may include a printed circuit board. The lamp holder may clamp or be otherwise mechanically and electrically secured to the printed circuit board and draw power from it. The printed circuit board may have traces from each lamp holder to be plugged into it. The printed circuit board may be part of a ballast printed circuit board assembly. The lamp holder printed circuit board may be connected to the ballast by any suitable connectors, such as male/female connectors. The ballast may be located either inside or outside a housing that may enclose the rigid power distribution unit. In some embodiments, the printed circuit board may be in electrical communication with the lamp holder via flat cable and male/female connectors.

In some embodiments, the rigid power distribution unit includes rails made of any suitable conducting metal such as copper, silver, brass or the like. For example, the conducting metal may be an abrasion-resistant metal, such as brass. The rigid power distribution unit may include a housing. The housing may be made of plastic, metal or other suitable enclosure material.

In some embodiments, the rigid power distribution unit includes a track. The track may be open on one or both ends for insertion of a lamp holder. An open end of the track may be blocked by a skirt after insertion of one or more lamp holders. The skirt may include any suitable material, such as a polymer or elastomer such as ethylene acrylic elastomer ("AEM") such as that available under the trademark "VAMAC" from E. I. DuPont and Co., located in Wilmington, Del. The material may be an elastomer, such as neoprene.

FIGS. 1-8 show illustrative embodiments and features of the invention.

FIG. 1 shows schematically lamp support 100. Lamp support 100 includes power input leads 102, ballast 104, rigid power distribution unit 106 and lamp holders 108. Lamp support 100 also includes rigid power distribution unit 110 and lamp holders 112. Each of lamp holders 108 has a facing lamp holder 112. Together, a pair of lamp holders—one 108 and a corresponding 112—hold a fluorescent lamp or tube at its ends. Lines $L_1$ represent the center lines of lamps that may be installed between corresponding lamp holders. Adjacent lines $L_1$ may be separated, for example, by center-to-center distance $C_1$.

Rigid power distribution units 106 and 110 may be affixed to an enclosure (not shown). Ballast 104 receive power via leads 102 and provide the power to lamp holders 108 via rigid power distribution unit 106. Rigid power distribution unit 106 may be connected to ballast 104 by connector 114. Connector 114 may be a pin connector or any other suitable connector. Rigid power distribution unit 110 may receive power from ballast 104 via leads 116.

One or both of rigid power distribution units 106 and 110 may include a printed circuit board for delivering power along traces or conductors to lamp holders 108 and 112, respectively. Positive and negative conductors, each corresponding to one of leads 102 and one of leads 116, may be provided along edges 118 and 120, respectively, of rigid power distribution units 106 and 110. The positive and negative conductors may match corresponding positive and negative terminals of lamp holders 108 and 112. The positive and negative conductors may be arranged in any suitable configuration. For example, in some embodiments, the positive and negative conductors may be, respectively, on top and bottom of edges 118 and 120. In some embodiments, both the positive and negative conductors both may on one side (top or bottom) of edges 118 and 120. The positive and negative conductors may be routed through their respective rigid power distribution units in any suitable manner to deliver power to positions on edges 118 and 120 where power is or may be desired. In some embodiments, power may be routed to points on edges 118 and 120. In some embodiments, power may be routed to elongated segments of edges 118 and 120. The segments may allow lamp holders 108 and 112 to be positioned with greater flexibility.

In some embodiments the segments may be sufficiently elongated that the lamp holder may be attached subject to an appropriate mechanical tolerance, but sufficiently restricted such that a properly installed lamp holder will shield the segment from contact with other objects. In some embodiments, the traces may be below the surface of the rigid power distribution unit. In those embodiments, the lamp holders may be provided with crimps or fasteners to make electrical contact with the traces. Rigid power distribution units 106 and 110 should be sufficiently rigid to mechanically support lamp holders 108 and 112 such that corresponding lamp holders can support and power a lamp.

Figure 2:
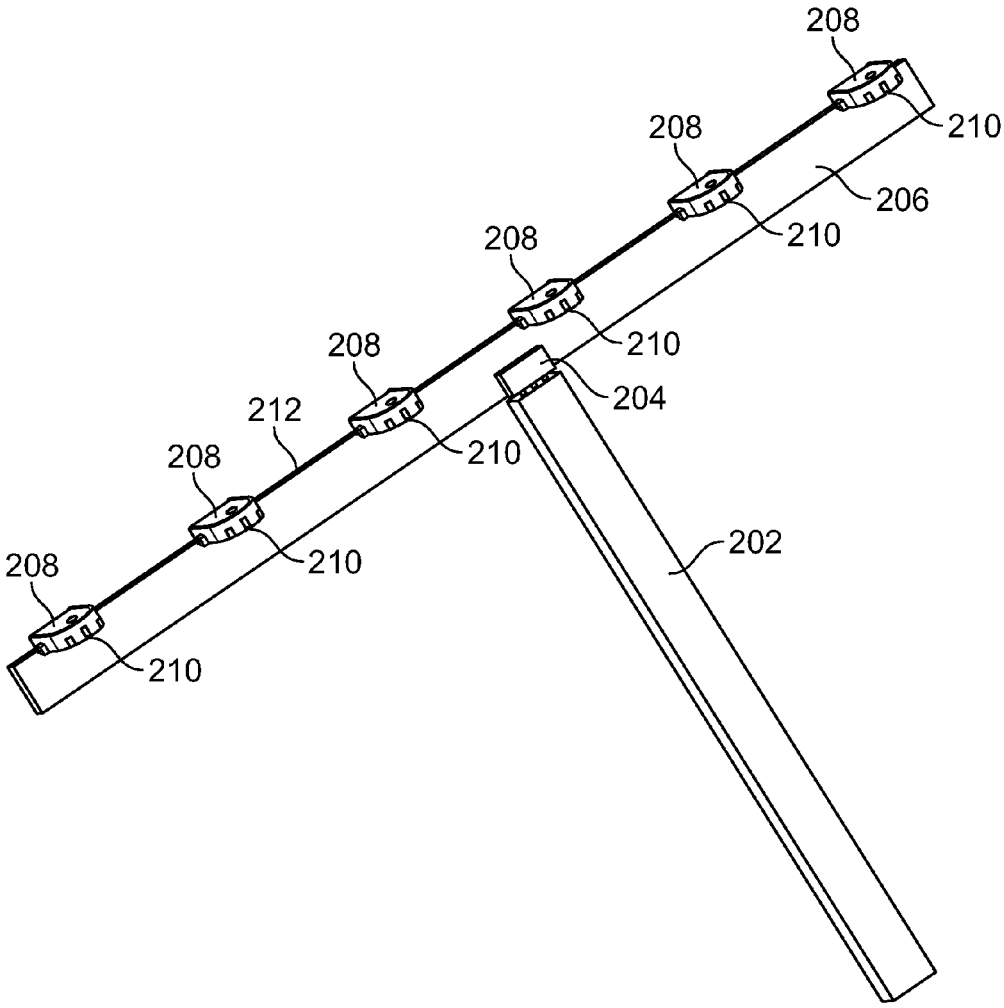
FIG. 2 is a perspective view of other apparatus in accordance with the present disclosure.

FIG. 2 shows in perspective, from below (in an operational orientation), illustrative lamp support 200. Lamp support 200 includes ballast 202. Ballast 202 connects via connector 204 to rigid power distribution unit 206. Rigid power distribution unit 206 may mechanically support lamp holders 208 via a press fit of lamp holders 208 onto edge 212. Edge 212 includes conductors to provide power to electrical terminals (not shown) of lamp holders 208. Rigid power distribution unit 206 may be a printed circuit board that has traces that deliver power to lamp holders 208. Lamp holders 208 may include pin slots 210 for receiving pins of fluorescent lamps.

Figure 3:
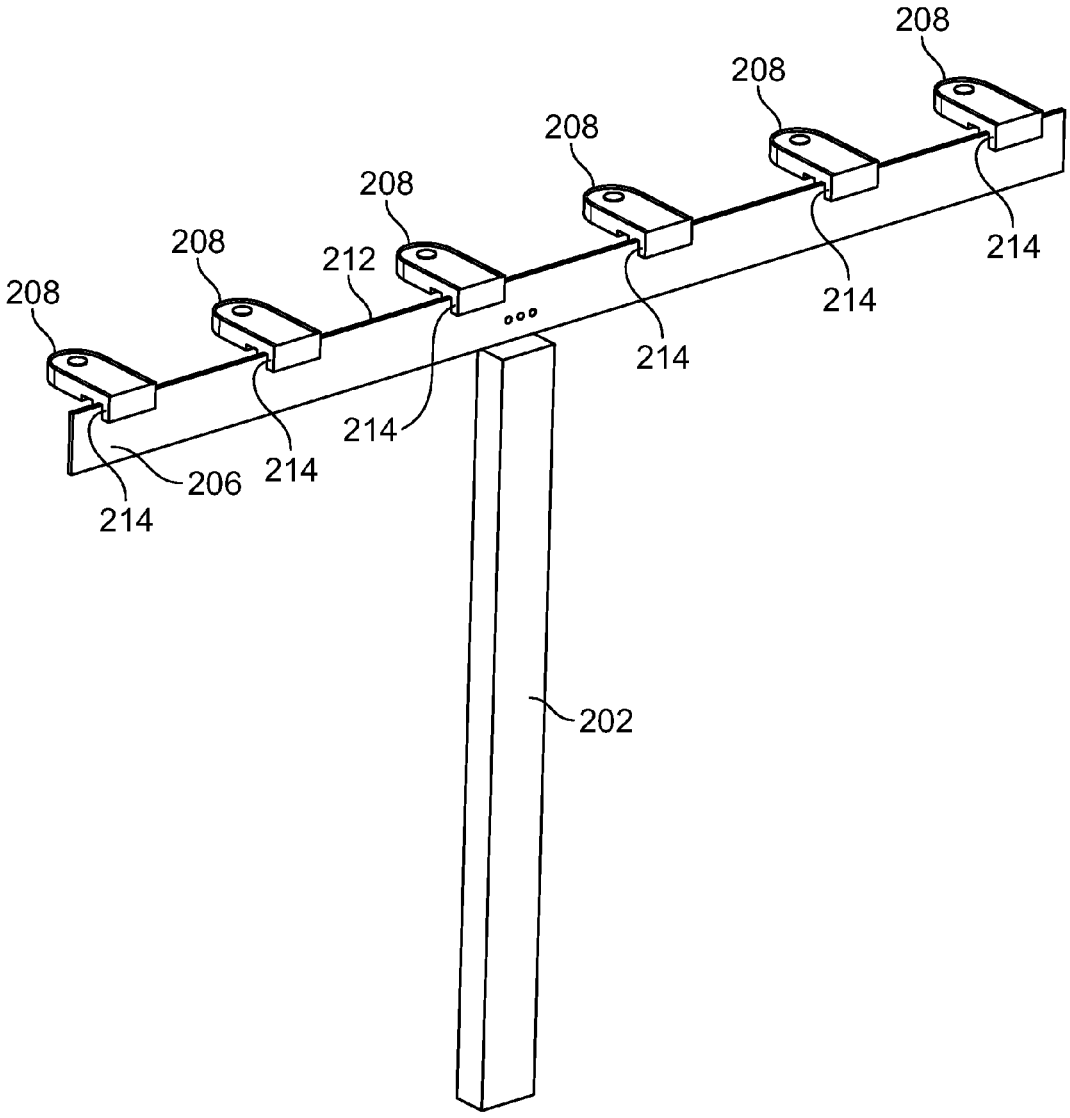
FIG. 3 is a different perspective view of the apparatus shown in FIG. 2.

FIG. 3 shows lamp support 200, in perspective, from above (in an operational orientation). Slots 214 in lamp holders 208 may be press fit onto edge 212. Slots 214 may include electrical terminals for transmitting power from edge 212 to lamps, when lamps are installed in lamp holders 208.

Figure 4:
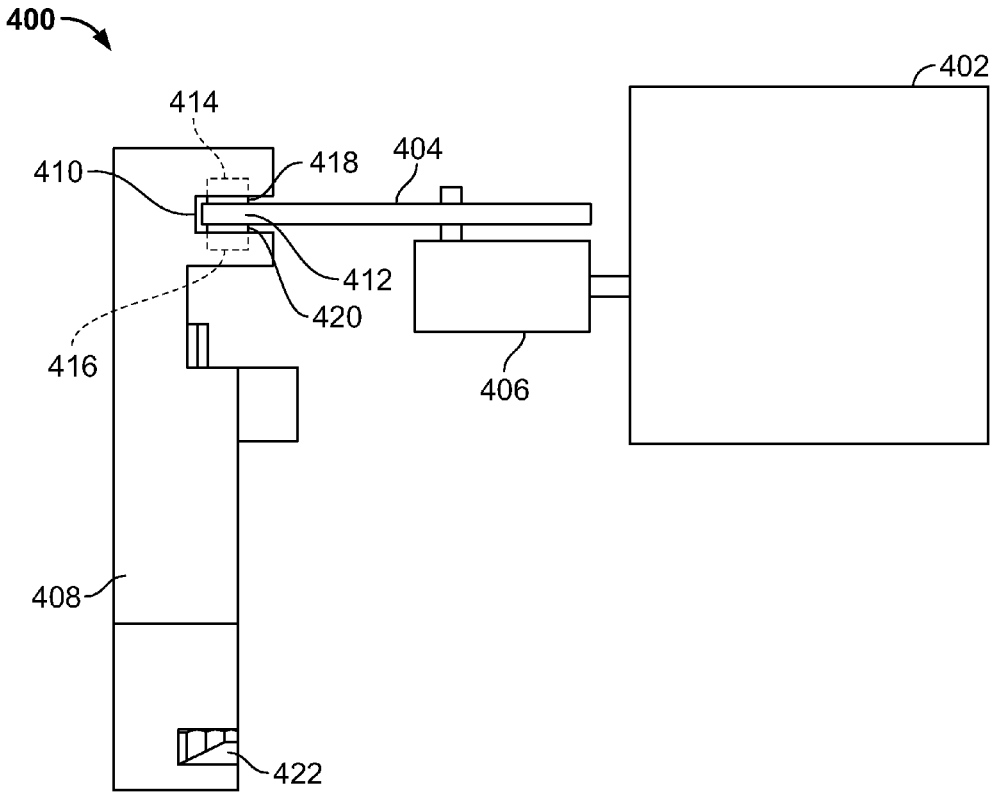
FIG. 4 is a side view, corresponding to the view along lines A-A shown in FIG. 1, of apparatus in accordance with the present disclosure.

FIG. 4 shows illustrative lamp support 400 in side view. The view shown in FIG. 4 may correspond to a side view along direction A-A, shown in FIG. 1. Lamp support 400 includes ballast 402. Lamp support 400 include rigid power distribution unit 404. Ballast 402 and rigid power distribution unit 404 may be electrically joined by connector 406. Lamp holder 408 may have groove 410 for mating with edge 412 of rigid power distribution unit 404. Groove 410 may include terminals 414 and 416 for contacting traces 418 and 420, respectively, on edge 412. Slot 422 may be provided for testing circuit continuity via lamp holder 408.

Figure 5:
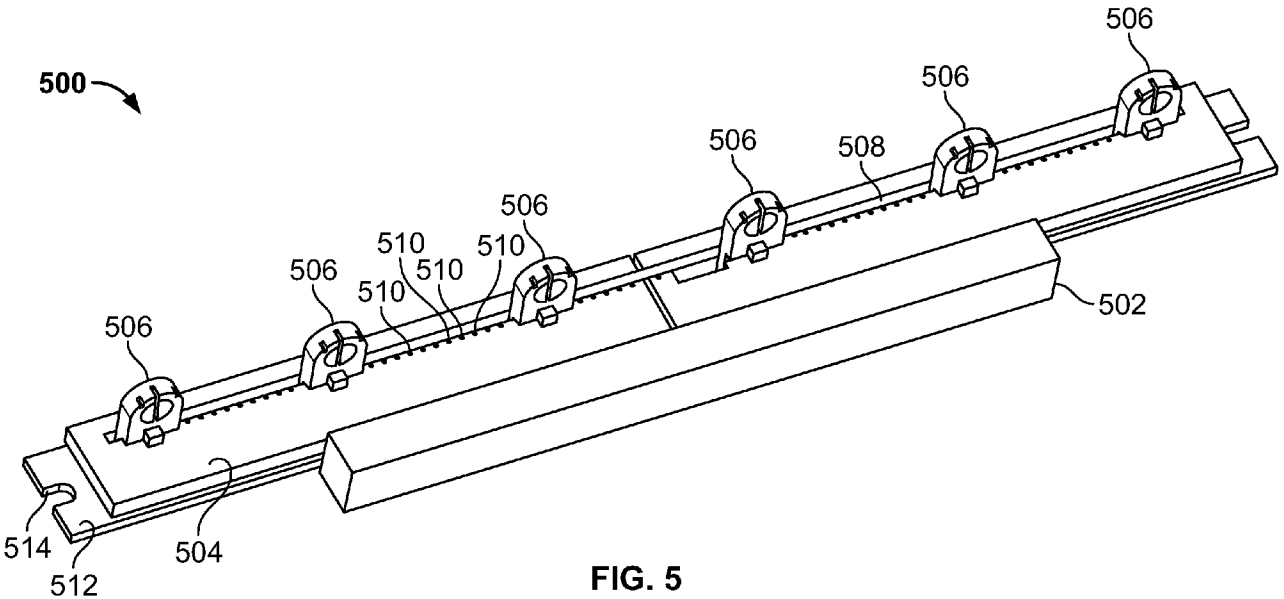
FIG. 5 is a perspective view of other apparatus in accordance with the present disclosure.

FIG. 5 shows illustrative lamp support 500. Illustrative lamp support 500 includes ballast 502 and rigid power distribution unit 504. Lamp holders 506 are slidably mounted in track 508 of rigid power distribution 504. Detents, such as detents 510, or any other suitable detents, may be present in or about track 508 to provide determined locations at which lamp holders 506 may be maintained. Ballast 502 may receive power via leads (not shown). Ballast 502 may provide power to rigid power distribution unit 504 via a connector (not shown). Ballast 502 may provide power to a distal power distribution unit (not shown) via leads (not shown). The distal power distribution unit may support a distal end of one or more lamps. (Rigid power distribution unit 504 may be referred to as a "proximal" power distribution unit, because it is adjacent ballast 502.)

Rigid power distribution unit 504 may be mounted to plate 512. Plate 512 may have any suitable features for attaching lamp support 500 to a lamp enclosure (not shown) or any other suitable structure.

Figure 6:
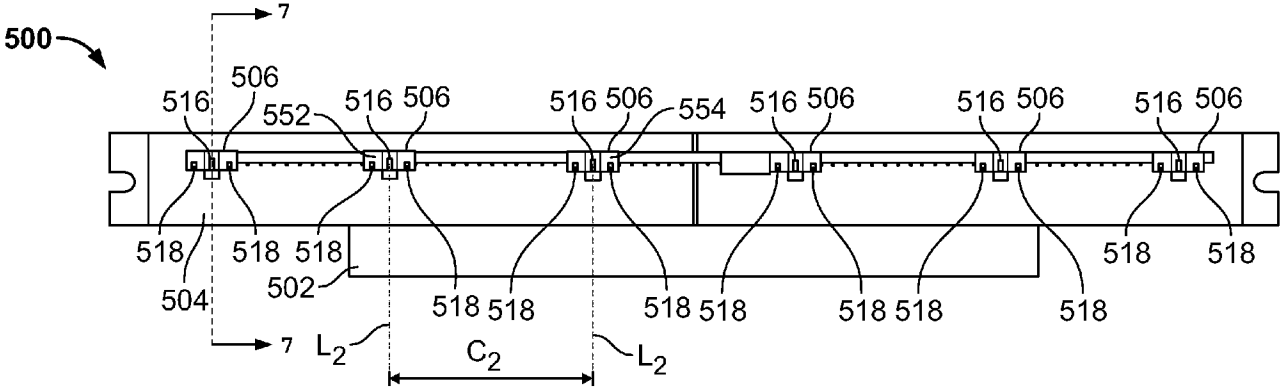
FIG. 6 is a top view of the apparatus shown in FIG. 5.

FIG. 6 shows a perspective view of lamp support 500. Lamp holders 506 may include slots 516 for receiving terminal pins from a lamp. (It will be appreciated that there are different arrangements by which lamp holders may mechanically and electrically engage lamps. Any suitable lamp holder may be used in conjunction with the lamp supports shown and described herein.) Test holes 518 may optionally be present in lamp holders 506 to receive continuity test probes.

FIG. 6 also shows lamp center lines $L_2$, which correspond to lamps that may be installed in lamp support 500. Distance $C_2$ between adjacent lines $L_2$ may be adjusted by sliding lamp holders 552 and 554. By adjusting $C_2$ during a manufacturing or assembly process, lamp support 500 may be used for different luminaires having different center-to-center lamp distances.

Figure 7:
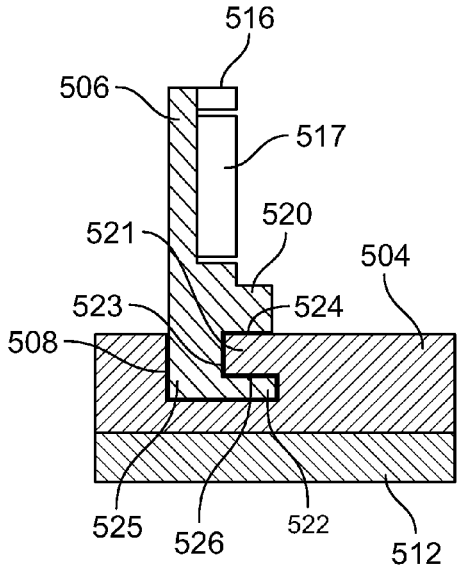
FIG. 7 is a partial cross-sectional view taken along lines 7-7 shown in FIG. 6.

FIG. 7 shows additional detail of the lamp holders 506 and their mechanical and electrical interface with rigid power distribution unit 504. Slots 516 may open up to a cavity (not shown) for receiving the end of a lamp. Contact pin guide 517 may guide pins at the end of the lamp during installation of the lamp in lamp holder 506. Lamp holder 506 may include groove 523, which may be defined at least in part by bosses 520 and 522. Groove 523 may receive tongue 521 of rigid power distribution unit 504. Knee 525 at the base of lamp holder 506 may occupy groove 508. Any suitable adjacent surfaces between lamp holder 506 and rigid power distribution unit 504 may be used for transferring electrical power between the two. For example, interfacial surfaces 524 and 526 may include electrical contacts for transferring the power. In general, positive and negative contact will be present on lamp holder 506 and rigid power distribution unit 504. In some embodiments, the positive and negative contacts may be in opposite sides of a structure, such as tongue 521. In some embodiments, the positive and negative contacts may be separated from each other, but on the same interfacial surface.

Figure 8:
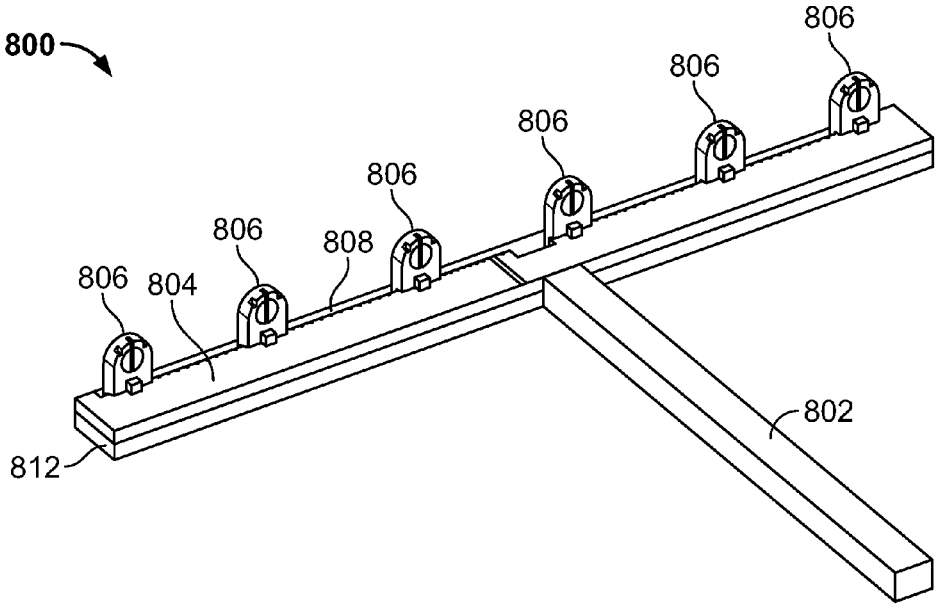
FIG. 8 is a perspective view of still other apparatus in accordance with the present disclosure.

FIG. 8 shows illustrative lamp support 800. Lamp support 800 includes ballast 802 in a perpendicular orientation with respect to rigid power distribution unit 804 and plate 812. Lamp holders 806 are slidably mounted in track 808. It will be appreciated that the ballasts shown and described herein may be mounted in any suitable orientation with respect to a corresponding rigid power distribution unit.

Thus, apparatus and methods for supporting and energizing a lamp have been provided. Persons skilled in the art will appreciate that the present invention can be practiced by other than the described embodiments, which are presented for purposes of illustration rather than of limitation, and the present invention is limited only by the claims which follow.

What is claimed is:

1. An apparatus for supporting a fluorescent lamp, the apparatus comprising:

a housing enclosing a rigid power distribution unit; and at least one lamp holder for engaging an end of a lamp, the rigid power distribution unit that transmits power to the lamp holder;

wherein:

the lamp holder is in slidable contact with the rigid power distribution unit so that a lateral center-to-center distance between the lamp and an adjacent lamp is adjustable; and the lamp holder is in electrical communication with the rigid power distribution unit such that when the lamp holder supports a lamp, the lamp holder is configured to provide power from the rigid power distribution unit to the lamp.

2. The apparatus of claim 1 further comprising a ballast that provides power from a power source to the rigid power distribution unit.

3. The apparatus of claim 2 wherein the rigid power distribution unit includes a printed circuit board that includes a conductor for transmitting power from the ballast to the lamp holder.

4. The apparatus of claim 3 wherein a portion of the printed circuit board is integral with the ballast, the portion including a reactive component and a power conditioning component.

5. The apparatus of claim 2 further comprising:

a first fitting on the ballast; and a second fitting on the rigid power distribution unit;

wherein the first fitting is configured to mate to the second fitting and form a pathway for delivering power from the ballast to the rigid power distribution unit.

6. The apparatus of claim 1 wherein the lamp holder is configured to hold an end of a fluorescent tube.

7. The apparatus of claim 1 wherein the rigid power distribution unit comprises:

a track having a first position and a second position;

a first conducting rail; and a second conducting rail;

wherein the first and second conducting rails are aligned with the track such that a lamp holder engaged to the rigid power distribution unit at either the first position or the second position is in electrical contact with the first and second conducting rails.

8. The apparatus of claim 7 wherein the lamp holder is slidable from the first position to the second position.

9. The apparatus of claim 7 wherein the track includes a detent for maintaining the lamp holder at one of the first and second positions.

10. The apparatus of claim 9 wherein:

the detent is one of a plurality of detents for maintaining the lamp holder at one of a plurality of positions, the plurality of positions including the first and second positions; and the detents are uniformly spaced apart from each other.

11. The apparatus of claim 9 further comprising, when the rigid power distribution unit is a first rigid power distribution unit and the detent is a first detent, a second rigid power distribution unit including a second detent;

wherein:

the second rigid power distribution unit is spaced apart from the first rigid power distribution unit such that the lamp can be positioned between the first and second rigid power distribution units; and the second detent is opposite the first detent such that the lamp can be maintained substantially perpendicular between the first and second rigid power distribution units.

12. A method for manufacturing a fluorescent lamp support, the method comprising:

providing a lamp holder for engaging an end of a lamp;

providing a rigid power distribution unit that is housed within a housing and includes a track; and sliding the lamp holder along the track, to a position in the track at which the lamp holder is in electrical contact with the rigid power distribution unit, to adjust the lateral center-to-center distance between the first lamp holder and a second lamp holder adjacent to the first lamp holder.

13. The method of claim 12 further comprising, when the rigid power distribution unit includes a connector, mating a ballast connector to the rigid power distribution unit connector, the mating to form an electrical connection between a ballast and the rigid power distribution unit connector.

14. The method of claim 12 wherein the sliding comprises sliding a lamp holder configured to hold a fluorescent tube.

15. The method of claim 12 further comprising affixing the rigid power distribution unit to a sheet metal enclosure.

16. The method of claim 13 further comprising, when the rigid power distribution unit is a first rigid power distribution unit:

attaching a second rigid power distribution unit to the enclosure; and wiring conducting rails of the second rigid power distribution unit to the ballast.

17. Apparatus for supporting at least two lamp holders, the lamp holders configured to support laterally spaced straight fluorescent tubes, the apparatus comprising:

a rigid base having a track, the track having a plurality of discrete lamp holder detents that are configured to maintain positions of the lamp holders;

a power distribution assembly including a power connector; and conductors connected to the power connector and electrically coupled to the lamp holders;

wherein each of the lamp holders is configured to:

engage an end of a corresponding one of the fluorescent tubes; and slide along the track to adjust a lateral center-to-center distance between adjacent fluorescent tubes.

18. The apparatus of claim 17 wherein the discrete lamp holder detents are spaced at regular intervals along the track.

19. The apparatus of claim 17 wherein the discrete lamp holder detents include recesses in an edge of the track for receiving a portion of the lamp holder.

20. The apparatus of claim 17 wherein the discrete lamp holder detents include teeth extending from an edge of the track for interfering with the movement of the lamp holder.

21. An apparatus for supporting a fluorescent lamp, the apparatus comprising:

a housing at least partially enclosing a ballast circuit and at least a portion of a rigid power distribution unit; and at least one fluorescent lamp holder for engaging an end of a lamp;

wherein:

the ballast circuit and the fluorescent lamp holder are in electrical communication with the rigid power distribution unit; and the lamp holder is slidably mounted to the rigid power distribution unit so that a lateral center-to-center distance between adjacent lamps is adjustable.

22. The apparatus of claim 21 wherein the at least one fluorescent lamp holder is slidable, with respect to the housing, from a first position to a second position.

23. The apparatus of claim 21 wherein the rigid power distribution unit includes a printed circuit board that includes a conductor for transmitting power from the ballast to the fluorescent lamp holder.

24. The apparatus of claim 23 wherein a portion of the printed circuit board is integral with a portion of the ballast circuit, the portion of the printed circuit board having a reactive component and a power conditioning component coupled thereto.

25. The apparatus of claim 21 wherein the rigid power distribution unit comprises:

a track having a first position and a second position;

a first conducting rail; and a second conducting rail;

wherein the first and second conducting rails are aligned with the track such that a fluorescent lamp holder engaged to the rigid power distribution unit at either the first position or the second position is in electrical contact with the first and second conducting rails.

26. The apparatus of claim 25 wherein the fluorescent lamp holder is engaged with the rigid power distribution unit and slidable from the first position to the second position.

27. An integrated ballast for a lamp fixture that is configured to support laterally spaced straight fluorescent tubes, the integrated ballast comprising:

a ballast circuit;

a ballast housing, the ballast circuit at least partially disposed within the ballast housing;

a plurality of fluorescent lamp holders mounted to the ballast housing;

a non-wire conductor; and a rigid power distribution unit;

wherein:

the rigid power distribution unit includes a track; and a portion of the non-wire conductor is disposed along at least a portion of the track for providing electrical current to the plurality of lamp holders at any point along the track.

28. The integrated ballast of claim 27 wherein the track includes a slot that is configured to guide the fluorescent lamp holder from a first position to a second position.

29. The integrated ballast of claim 28 wherein:

the rigid power distribution unit includes an edge; and the slot has a longitudinal axis that is substantially parallel to the edge.

* * * * *